US008376706B2

(12) United States Patent
Bunker et al.

(10) Patent No.: US 8,376,706 B2
(45) Date of Patent: Feb. 19, 2013

(54) TURBINE AIRFOIL CONCAVE COOLING PASSAGE USING DUAL-SWIRL FLOW MECHANISM AND METHOD

(75) Inventors: Ronald Scott Bunker, Niskayuna, NY (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1166 days.

(21) Appl. No.: 11/863,744

(22) Filed: Sep. 28, 2007

(65) Prior Publication Data

US 2009/0087312 A1 Apr. 2, 2009

(51) Int. Cl.
*F01D 5/18* (2006.01)

(52) U.S. Cl. ..... 416/96 R

(58) Field of Classification Search ..... 415/115; 416/97 R, 97 A, 96 A
See application file for complete search history.

(56) References Cited

U.S. PATENT DOCUMENTS 4,416,585 A * 11/1983 Abdel-Messeh ..... 416/97 R
5,197,852 A 3/1993 Walker et al.
5,328,331 A 7/1994 Bunker et al.
5,431,537 A * 7/1995 Sturm ..... 416/97 R
5,611,197 A 3/1997 Bunker
5,660,525 A 8/1997 Lee et al.
5,822,853 A 10/1998 Ritter et al.
6,000,908 A 12/1999 Bunker
6,068,445 A * 5/2000 Beeck et al. ..... 416/96 R
6,116,854 A * 9/2000 Yuri ..... 416/97 R
6,174,133 B1 1/2001 Bunker
6,183,197 B1 2/2001 Bunker et al.
6,227,804 B1 * 5/2001 Koga et al. ..... 416/96 R
6,261,054 B1 7/2001 Bunker et al.
6,386,827 B2 5/2002 Yu et al.
6,406,260 B1 * 6/2002 Trindade et al. ..... 416/96 R
6,427,327 B1 8/2002 Bunker et al.
6,435,814 B1 8/2002 Yu et al.
6,504,274 B2 1/2003 Bunker et al.
6,506,013 B1 1/2003 Burdgick et al.
6,506,022 B2 1/2003 Bunker
6,589,010 B2 7/2003 Itzel et al.
6,641,362 B1 * 11/2003 Anding et al. ..... 415/115
6,644,921 B2 11/2003 Bunker et al.
6,681,578 B1 1/2004 Bunker
6,695,582 B2 2/2004 Bunker et al.
6,722,134 B2 4/2004 Bunker
7,011,502 B2 3/2006 Lee et al.
7,066,716 B2 6/2006 Jacala et al.
7,086,829 B2 8/2006 Fuller et al.
7,104,067 B2 9/2006 Bunker
7,121,796 B2 10/2006 Burdgick et al.
(Continued)

OTHER PUBLICATIONS

Han et al., Gas Turbine Heat Transfer and Cooling Technology, 2000, Taylor & Francis, p. 313-325.*

*Primary Examiner* — Edward Look
*Assistant Examiner* — Jesse Prager
(74) *Attorney, Agent, or Firm* — Nixon & Vanderhye P.C.

(57) ABSTRACT

A turbine airfoil includes a leading edge having a concave cooling flow passage. An apex of the concave cooling flow passage divides the flow passage into adjacent regions. The turbine airfoil includes a first plurality of turbulators disposed in one of the adjacent regions, and a second plurality of turbulators disposed in the other of the adjacent regions. The first and second pluralities of turbulators are positioned relative to one another to divert cooling flow in opposing swirl streams that recombine along the apex and to effect a desired heat transfer and pressure loss.

5 Claims, 3 Drawing Sheets

U.S. PATENT DOCUMENTS

| | | | | |
|---|---|---|---|---|
| 7,134,842 | B2 | 11/2006 | Tam et al. | |
| 7,147,439 | B2 | 12/2006 | Jacala et al. | |
| 7,163,376 | B2 | 1/2007 | Itzel et al. | |
| 7,186,091 | B2 | 3/2007 | Lee et al. | |
| 2005/0025623 | A1 * | 2/2005 | Botrel et al. | 416/97 R |
| 2006/0120868 | A1 * | 6/2006 | Dorling et al. | 416/97 R |
| 2007/0297916 | A1 * | 12/2007 | Levine et al. | 416/96 R |
| 2007/0297917 | A1 * | 12/2007 | Levine et al. | 416/96 R |

* cited by examiner

TURBINE AIRFOIL CONCAVE COOLING PASSAGE USING DUAL-SWIRL FLOW MECHANISM AND METHOD

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF INVENTION

The invention relates to turbine airfoil construction and, more particularly, to a turbulator configuration in the concave interior surface of an airfoil leading edge.

In general, increased internal cooling magnitudes are desired for any cooled gas turbine airfoil. The leading edge cooling passage of any such airfoil experiences the highest heat load on the airfoil, and so requires the highest degree of internal cooling. This requirement is much more highly evident for closed-circuit cooled airfoils, such as the steam-cooled buckets of General Electric's H-system turbine® (but the requirement holds for all cooled turbines). Solutions that allow high heat transfer coefficients, uniformity of heat transfer, and also lower friction coefficients are continuously sought. Any solution should also be manufacturable, preferably by investment casting methods.

In open-circuit air-cooled turbine airfoils, solutions generally include the increase of film cooling in the airfoil leading edge to compensate for lower internal heat transfer, or the increase in impingement heat transfer into the concave leading edge passage if enough pressure head is available. Swirl cooling by wall-jet injection is another solution. In closed-circuit cooled airfoils, solutions generally revolve around limited forms of turbulation on the concave surface.

The primary solution in the current art for closed-circuit cooling is the use of transverse repeated turbulators, i.e., the turbulators are arranged substantially perpendicular to a longitudinal axis of the passage. FIG. 1 shows the prior art layout of a concave cooling passage 2 including transverse turbulators 3. FIG. 2 is an end view showing the concave shape of the cooling passage. If the turbulators 3 are transverse and each a continuous strip, they act in the conventional manner by tripping the flow to provide mixing. The conventional methodology leads to high heat transfer and high friction coefficients. This is the case regardless of the concave shape of the airfoil leading edge.

It has been proposed to angle the turbulators 3 to the flow as shown in FIG. 3. If the turbulators 3 are angled to the flow, such as the 45° angled version of FIG. 3, but still of continuous form within the concave portion, then a portion of the flow is diverted to follow the turbulators 3 near the surface creating a swirling flow in the semi-circular shaped passage 2. This serves to substantially lower the coefficient of friction while also delivering a high heat transfer coefficient. The uniformity of the heat transfer however is not high. Also, this geometry is not amenable to an investment casting process because the turbulators 3 are continuously angled across the concave surface. The variation in cast shape of these turbulators 3 will be large, with regions of undesirable turbulator lean or size.

It would thus be desirable to provide a leading edge construction with a turbulator arrangement that effects high heat transfer with lower friction losses while also being castable by investment casting methods.

BRIEF SUMMARY OF INVENTION

In an exemplary embodiment, a turbine airfoil includes a leading edge having a concave cooling flow passage. An apex of the concave cooling flow passage divides the flow passage into adjacent regions. The turbine airfoil includes a first plurality of turbulators disposed in one of the adjacent regions, and a second plurality of turbulators disposed in the other of the adjacent regions. The first and second pluralities of turbulators are positioned relative to one another to divert cooling flow in opposing swirl streams that recombine along the apex and to effect a desired heat transfer and pressure loss.

In another exemplary embodiment, a turbine airfoil includes a plurality of turbulators disposed in each of the adjacent regions at opposite angles relative to a direction of the cooling flow, wherein the turbulators are positioned relative to one another and are sized and shaped to divert cooling flow in opposing swirl streams that recombine along the apex and to effect a desired heat transfer and pressure loss.

In still another exemplary embodiment, a method of constructing a turbine airfoil leading edge having a concave cooling flow passage includes the step of casting the concave cooling flow passage with a first plurality of turbulators and a second plurality of turbulators, the first and second pluralities of turbulators being positioned relative to one another to divert cooling flow in opposing swirl streams that recombine along an apex of the concave cooling flow passage and to effect a desired heat transfer and pressure loss.

DETAILED DESCRIPTION OF INVENTION

Figure 6:
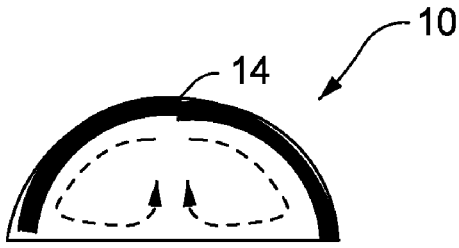
FIG. 6 is an end view of the concave cooling flow passage shown in FIG. 5.
Figure 5:
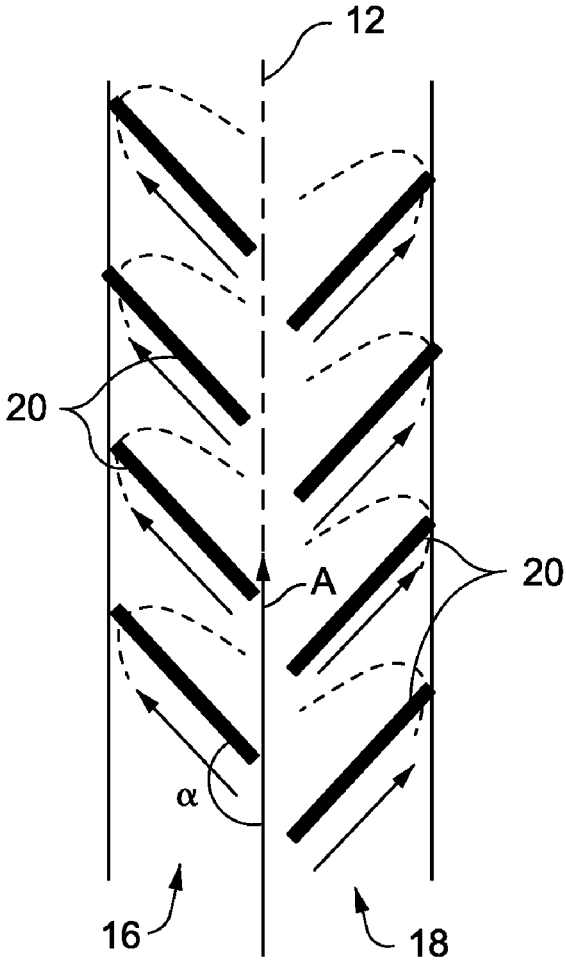
FIG. 5 shows the concave cooling flow passage including turbulators arranged as alternating angled strips.

With reference to FIGS. 5 and 6, the turbulator design is configured to accommodate the concave nature of the leading edge 10 in both flow and manufacturing. For manufacturing, this means allowing a split line 12 along the airfoil apex region 14 that divides the turbulation mechanism into two adjacent regions, or halves 16, 18. This substantially decreases or eliminates the casting variation and complexity associated with angled turbulators in the concave region. Two sets of turbulators 20 are then set at an obtuse angle $\alpha$ relative to the bulk flow direction (see arrow A) to induce the near-surface flow to follow the direction of the turbulators 20, at least in part, as depicted in FIG. 5. Preferably, the obtuse angle is about 135°, although other angles could be utilized to generate the desired heat transfer and pressure loss.

The two adjacent sets of turbulators 20 are preferably oriented in mirror image arrangement such that the near surface flow proceeds in two opposing directions, creating two opposed swirl flows as shown in FIG. 6. Because the passage 10 is concave, these opposed swirl flows recombine away from the surface to be cooled, and then redirect back to the apex region 14, thus reinforcing the entire dual-swirl flow mechanism. This deliberate dual-swirl flow provides highly elevated heat transfer coefficients and very much lower friction coefficients as the flow is no longer being forcibly disrupted by transverse turbulators. In addition, the circulation brings the cooler flow from the core of the cooling flow out to the metal surface to be cooled, further enhancing the cooling effectiveness.

This configuration can be used with closed-circuit cooling, or with air-cooled open-circuit cooling, with or without film extraction, with or without impingement cooling or wall-jet cooling.

Figure 7:
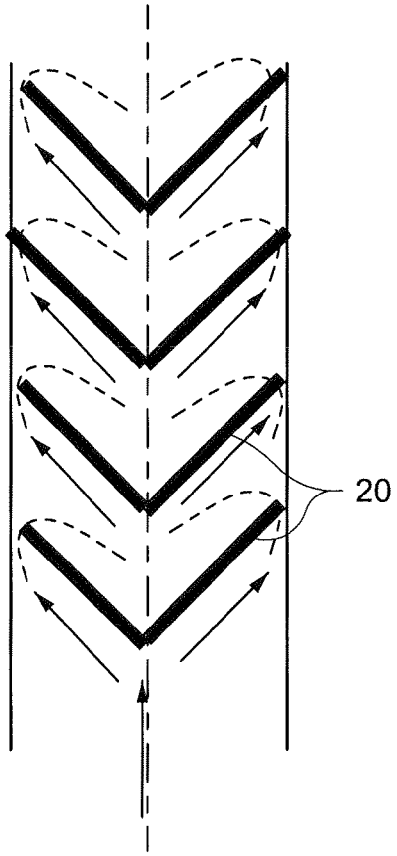
FIGS. 7 and 8 show alternative arrangements of the turbulators.
Figure 8:
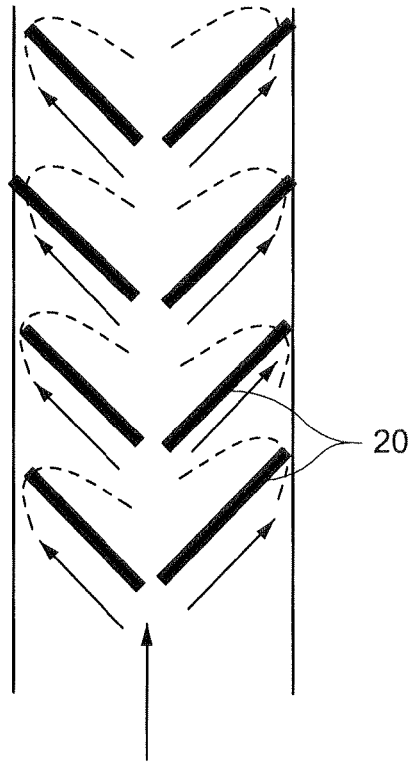

As shown in FIG. 5, the turbulators 20 in the adjacent regions 16, 18 are disposed in a staggered relationship, or a broken V-shape (a so-called broken chevron). The separated nature of the adjacent turbulators 20 at the apex 14 enhances the heat transfer in that region, whereas joined turbulators of opposite angle would create instead a lower heat transfer. Staggering the two sets of turbulator strips 20 in the broken chevron is not a requirement for the benefit, but will result in a better design for casting purposes. Turbulators 20 in a chevron configuration (an unbroken V-shape) are shown in FIGS. 7 and 8. In FIG. 7, curved chevron turbulators 20 are aligned such that there is no stagger, and no break along the apex region. In fact, the casting process will require that the split line between two die-pulls be located along the apex dashed line of this geometry, since the two sets of turbulators 20 are at differing angles. The separation line is physical, but can have a vanishingly small gap between the turbulators 20. In FIG. 8, the turbulators 20 are also aligned, not staggered, but there is a gap between the two sets of turbulators 20 to make the casting process easier (i.e., less susceptible to out-of-spec dimensions).

Additionally, the airfoil leading edge passage 10 need not be strictly semi-circular either, but generally concave.

Dual-swirl flow inside a concave flow passage 10, induced by opposing sets of angled turbulators 20 serve to separate the flow at the apex region 14 into two opposed swirl legs (see FIG. 6). The reinforcement of opposing swirl flows reduces the friction coefficient by reducing the energy losses previously experienced in highly separated turbulated flows. The strong swirl flow maintains the elevated heat transfer levels required, and the angled turbulators 20 also add more heat transfer surface area. The illustrated configuration is castable by conventional means such as by investment casting or any of several methods known in the art that result in integrally cast metal parts.

An exemplary process for casting an airfoil calls for at least two die-pulls that represent the two halves of the airfoil, pressure and suction sides, split along the leading and trailing edges. The geometry of the turbulators 20 is fixed by the ceramic core and the limitation imposed by the economical number of die-pulls. There is a die set for the ceramic core that defines the interior cooling passage surface, and another die set for the exterior of the airfoil. Each die set operates in a similar fashion using at least two die-pulls.

Figure 2:
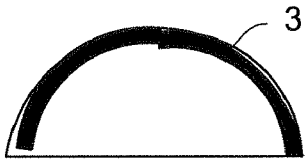
Fig. 2 (PRIOR ART)
FIG. 2 is an end view of the leading edge portion showing a position of the turbulators in the concave interior surface.
Figure 4:
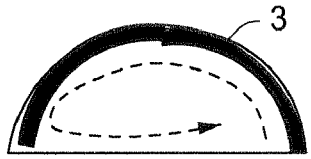
FIG. 4 is an end view of the concave cooling flow passage of FIG. 3.
Figure 1:
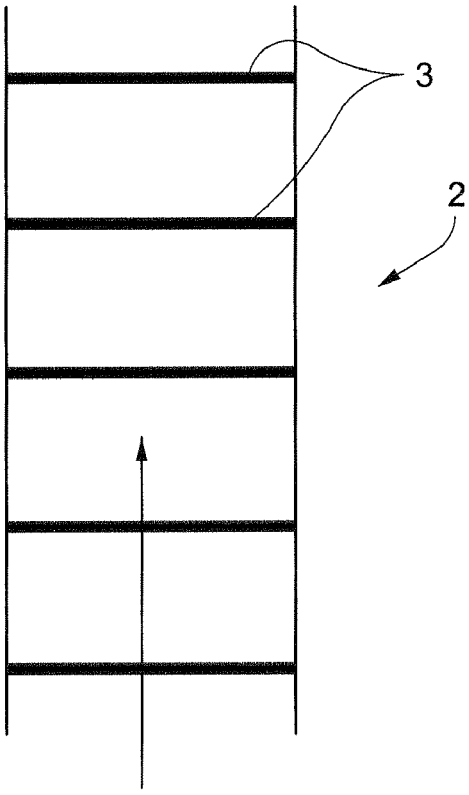
Fig. 1 (PRIOR ART)
FIG. 1 shows a conventional cooling passage with transverse turbulators.
Figure 3:
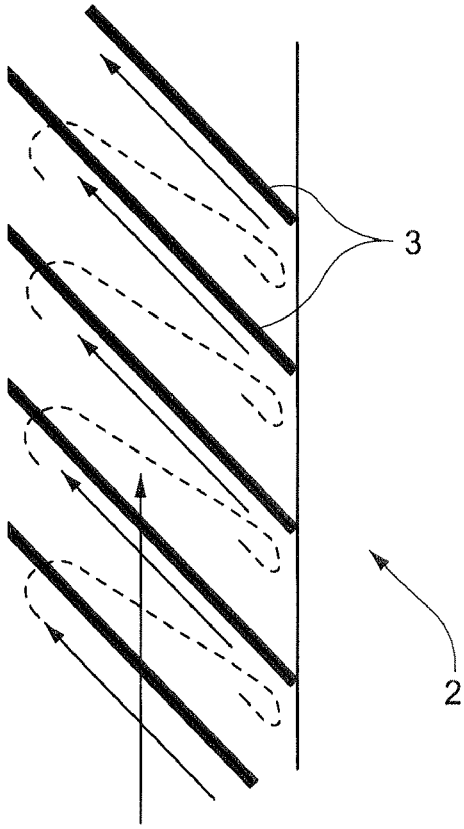
FIG. 3 is a proposed solution to problems with the FIG. 1 construction including turbulators that are angled to the flow.

Lab model testing was conducted in a concave flow passage under engine typical non-dimensional flow conditions. Tests were conducted for a non-turbulated passage, a passage with transverse turbulators (FIG. 1), one with continuous 45° turbulators (FIG. 3), and the geometry of the described embodiments. Results showed heat transfer at least equal to that of transverse turbulators (higher when surface area is added), and 50% reduced friction coefficient, respectively. Testing indicated much more uniform heat transfer is also evident.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A turbine airfoil including a leading edge having a concave cooling flow passage with a substantially semi-circular shape, wherein an apex of the concave cooling flow passage divides the flow passage into adjacent regions, the turbine airfoil comprising a plurality of turbulators disposed in each of the adjacent regions at opposite angles relative to a direction of the cooling flow, the turbulators being substantially semi-circular shaped corresponding to the substantially semi-circular shape of the flow passage, the turbulators having a substantially constant height and width in a lengthwise direction, and the turbulators extending substantially to the apex of the concave cooling flow passage, with the turbulators in one of the adjacent regions closer to the apex than the turbulators in the other of the adjacent regions and do not extend past the apex, wherein the turbulators are positioned relative to one another and are sized and shaped to divert cooling flow in opposing swirl streams that recombine along the apex and to effect a desired heat transfer and pressure loss, and wherein the turbulators on opposite regions of the cooling flow passage are disposed in a broken and staggered chevron configuration.

2. A turbine airfoil according to claim 1, wherein the opposite angles are between ±120° and ±150°, respectively.

3. A turbine airfoil according to claim 1, wherein the concave cooling flow passage and the turbulators are castable.

4. A turbine airfoil according to claim 1, wherein the turbulators are sized and shaped to divert the cooling flow and to effect the desired heat transfer and pressure loss.

5. A turbine airfoil according to claim 1, wherein the turbulators on opposite regions of the cooling flow passage are staggered such that inner ends of the turbulators in one region are disposed substantially mid-way between inner ends of the turbulators in the opposite region.

* * * * *